United States Patent [19]

Kreissig et al.

[11] 4,287,832

[45] Sep. 8, 1981

[54] TRANSVERSELY TORSIONALLY INTERCONNECTED RAILWAY VEHICLE TRUCKS

[75] Inventors: Ernst Kreissig, Seuzach; Friedrich Steinmann, Weisslingen, both of Switzerland

[73] Assignee: Schweizerische Lokomotive-und Maschinenfabrik, Winterthur, Switzerland

[21] Appl. No.: 923,298

[22] Filed: Jul. 10, 1978

[30] Foreign Application Priority Data

May 9, 1978 [CH] Switzerland ..... 4997/78

[51] Int. Cl.[3] ..... B61F 3/08; B61F 5/44; B61F 5/50

[52] U.S. Cl. ..... 105/176; 105/167; 105/168; 105/182 R; 308/72

[58] Field of Search ..... 105/165–169, 105/176, 4 R, 3, 182 R; 308/72; 267/57

[56] References Cited

U.S. PATENT DOCUMENTS

| | | | |
|---|---|---|---|
| 1,618,354 | 2/1927 | Ritt | 308/72 |
| 1,728,096 | 9/1929 | Algrain | 105/168 |
| 3,403,899 | 10/1968 | Plume | 267/154 |
| 3,961,583 | 6/1976 | Fagel | 105/4 R |

FOREIGN PATENT DOCUMENTS

| | | | |
|---|---|---|---|
| 189500 | 3/1955 | Sweden | 105/4 R |
| 328306 | 4/1958 | Switzerland | 105/168 |

*Primary Examiner*—Joseph F. Peters, Jr.
*Assistant Examiner*—Howard Beltran
*Attorney, Agent, or Firm*—Kenyon & Kenyon

[57] ABSTRACT

The transverse coupling assembly for the end trucks utilizes a hollow shaft which is mounted via a bearing to a middle truck or vehicle body and connected via linkages to the two end trucks. In one embodiment, the shaft houses a torsion spring element which is pretensioned and which connects the shaft to a linkage. In another embodiment, the shaft can be provided with partitions to form a storage space for a fluid operating medium, diesel oil or the like.

13 Claims, 7 Drawing Figures

TRANSVERSELY TORSIONALLY INTERCONNECTED RAILWAY VEHICLE TRUCKS

This invention relates to a transverse coupling assembly for a rail vehicle.

Heretofore, it has been known to couple the trucks of a rail vehicle together by means of a transverse coupling so that horizontal forces can be transmitted from one truck to the other. The purpose of this is to reduce the forces which act on the wheel sets of the end trucks when traversing a track curve, that is the forces occurring between the rim of the wheels and the rail of the track.

One known transverse coupling assembly is described in Swiss Pat. No. 328,306 (and corresponding Swedish Pat. No. 189,500) for use with a rail vehicle having three trucks. In this case, the ends of the end trucks which face each other are coupled to each other by means of a linkage which includes a torsion shaft supported in bearings of the middle truck, two levers which are fastened to the shaft and which are parallel and of equal length to each other, and two transverse steering arms which connect the lever ends to the truck ends. In coupling assemblies of this type, the torsion shaft is constructed as a solid shaft of high strength steel and is kept thin for reasons of weight. The torsion shaft is also rather long and, consequently, has great elasticity with respect to torsion as well as to bending. In some constructions, this is undesirable since the operation of the transverse coupling assembly can be disturbed.

Accordingly, it is an object of this invention to provide a transverse coupling assembly wherein use can be made of a torsion shaft of relatively great stiffness with respect to torsion as well as bending.

It is another object of the invention to provide a transverse coupling assembly for a rail vehicle which can perform other functions in addition to guiding a pair of truck ends in parallel relation.

Briefly, the invention provides a transverse coupling assembly for a rail vehicle having at least two longitudinally spaced trucks on which a vehicle body is supported. The coupling assembly is comprised of a hollow shaft, a means for supporting each end of the shaft relative to the vehicle body and a pair of linkages each of which connects a shaft end to a truck.

In one embodiment, a torsion spring element extends within the hollow shaft at least over one end section. The spring element is secured at one end to the shaft and is relatively rotatable at the opposite end to the shaft over a predetermined angle. In addition, a lever is secured to and between the rotatable end of the torsion spring element and the linkage at that end of the shaft. The torsion spring element is able to function as a restoring spring and can replace the spring assembly which is customarily used as a restoring spring in a linkage, for instance in a transverse steering rod. In this embodiment, the ends of the shaft can be supported in a joint-like external bearing which is mounted in a pillow block.

In another embodiment, the hollow shaft is provided with a pair of spaced apart partitions which define a storage space for receiving a fluid operating medium. For example, the medium may be a supply of compressed air which can be utilized in a pneumatic control system of the rail vehicle. Alternatively, the storage space may contain diesel oil or any other suitable medium. In this embodiment, the ends of the shaft can be supported on a joint-like internal bearing disposed within an end of the shaft with an inner ring of the bearing secured to a journal pin in a pillow block.

The hollow shaft of the coupling assembly has a greater torsion and bending stiffness than shafts of previously known coupling assemblies. Further, the hollow space within the shaft can be used for purposes, for example as described above, which can lead to savings in space and a greater economy.

These and other objects and advantages of the invention will become more apparent from the following detailed description taken in conjunction with the accompanying drawings wherein.

Figure 1:
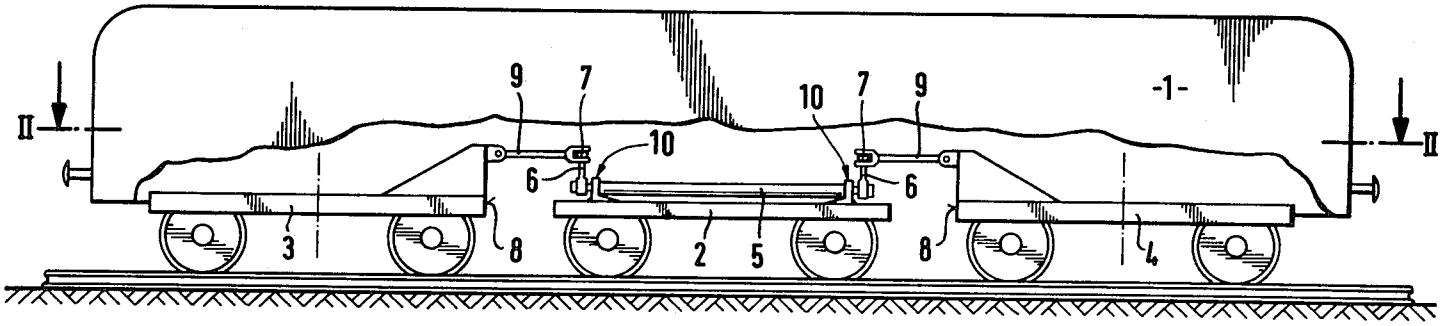
FIG. 1 illustrates a side view of a rail vehicle incorporating a transverse coupling assembly according to the invention.
Figure 2:
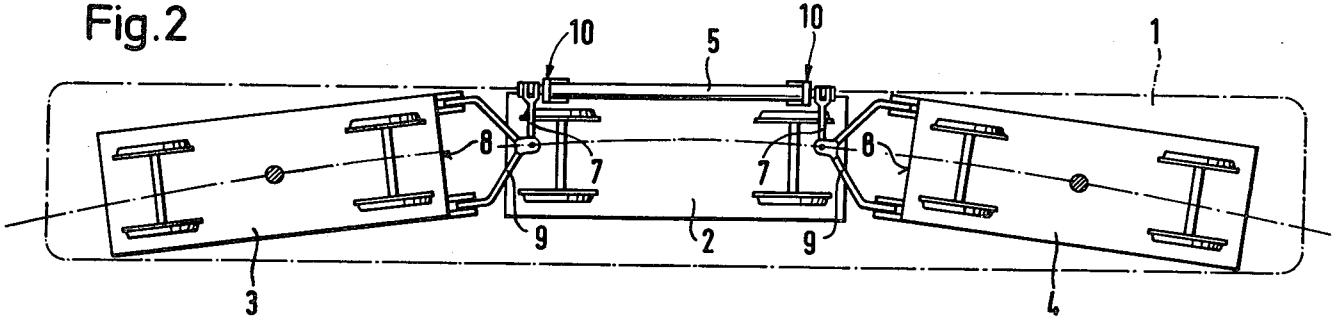
FIG. 2 illustrates a top view of FIG. 1 with the rail vehicle in a track curve.

Referring to FIGS. 1 and 2, the rail vehicle includes a vehicle body 1 which is supported on three trucks 2, 3, 4. As shown, the two end trucks 3, 4 are coupled to the middle truck 2 via a transverse coupling assembly. The coupling assembly includes a hollow shaft 5 which is disposed longitudinally of the trucks 2, 3, 4, a bearing means 10 supporting each end of the shaft 5 relative to the vehicle body 1 and a pair of linkages which connect the end trucks 3, 4 to a respective end of the shaft 5. Each linkage includes a lever 6 connected to the shaft 5, a horizontally disposed steering rod 7 which is connected to the top of the lever 6 and a triangular frame 9 which is connected to a face 8 of an end truck 3, 4 and to the steering rod 7. The bearing means 10 for supporting the ends of the shaft 5 are arranged at a distance from each other so that the levers 6 can swing out sideways, as viewed, and the ends 8 of the two end trucks 3, 4 can move freely relative to the middle truck 2.

Figure 4:
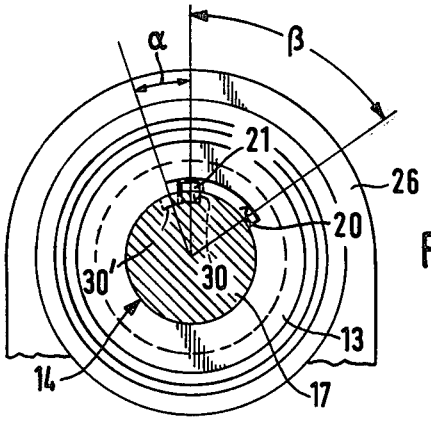
FIG. 4 illustrates a view taken on line IV—IV of FIG. 3.
Figure 3:
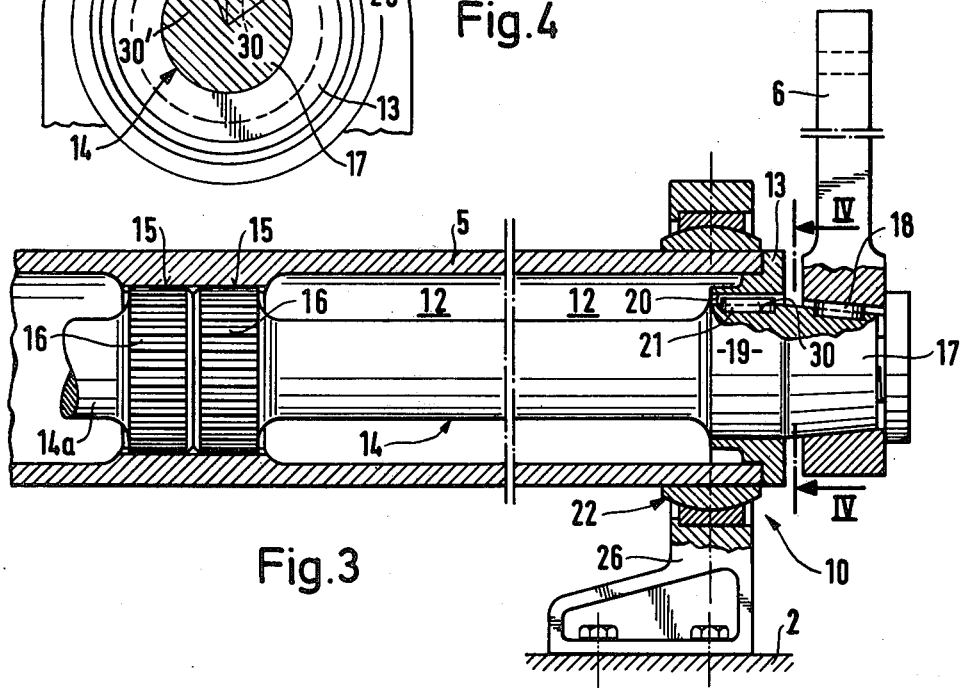
FIG. 3 illustrates a longitudinal cross-sectional view of part of the coupling assembly of FIG. 1.

Referring to FIGS. 3, the shaft 5 is coupled to the end trucks 3, 4 in similar manner and therefore only one end need be described. In this regard, the hollow shaft 5 carries an annular disk 13 at each end which defines an aperture and has a torsion spring element 14 extending within the end section. As shown, the spring element 14 is provided with a serration 16 which mates with a suitable surface on the inside of the shaft 5 such that the end of the element 14 is fixedly secured to the shaft 5. In addition, the opposite end of the spring element 14 is disposed to be relatively rotatable to the shaft 5 within a predetermined angle $\beta$ (see FIG. 4). For this purpose, the outer end of the spring element 14 has a cylindrical part 19 which passes through the aperture in the disk 13. This cylindrical part 19 is provided with a slot 30 in which a key 21 is mounted to project into an arcuate recess 20 formed in the disk 13. As shown in FIG. 4, the arcuate length of the recess 20 corresponds to the angle $\beta$.

When assembling the torsion spring element 14 in the shaft 5, the serrated end is first fitted into the shaft 5 in such a manner that the slot 30 occupies a position 30' (FIG. 4) offset from the vertical by an angle $\alpha$. The torsion spring element 14 is then pretensioned by turning the element 14 clockwise as viewed in FIG. 4 through the angle $\alpha$.

The slot 30 then moves into alignment with one end of the recess 20 and the key 21 is inserted. The key 21 thereafter retains the spring element 14 in this pretensioned position relative to the shaft 5.

The free end of the torsion spring element 14 also has a conical part 17 which extends from the end of the shaft 5 and is secured to the lever 6 of a linkage via a key 18. As shown in FIG. 3, the lever 6 is held in place axially of the spring element 14 by an enlarged portion at the end of the conical part 17. This enlarged portion can be formed in any suitable known manner.

The shaft 5 also carries an identical spring element **14*a* at the opposite end which is coaxial with the spring element 14. This spring element 14*a* is mounted on the shaft 5 in the same manner. As viewed in FIG. 4, the spring element 14*a* is tensioned in the same sense, i.e. clockwise. In this regard, the angle of rotation B is determined by the recess 20*a* in a corresponding disk 13, aligned with the recess 20**, and a respective stop key.

The two bearing means 10 for the shaft 5 are also of identical construction and each contains a joint-like external bearing 22 which is arranged in a pillow block 26. The pillow block 26 is, in turn, secured to the middle truck 2 but may also be arranged on the vehicle body 1.

During use, the pretensioned torsion spring elements 14, **14*a* each allow one of the levers 6 to move relative to the shaft 5. Thus, the spring elements 14 serve as a return or restoring spring so that the transverse steering rods 7 which are linked to the free ends of the levers 6 (FIG. 2) can interact elastically under tension as well as under a compression load. Accordingly, these torsion spring elements 14, 14*a* insure the elasticity of the connection between the end trucks 3, 4** required for the proper operation of the transverse coupling assembly, especially when negotiating sharp S-curves.

The two levers 6 are thus practically rigidly coupled together via the tension torsion spring elements 14, **14*a* and the hollow shaft 5 so long as the forces to be transmitted do not exceed the maximum given by the initial tensions of the torsion spring elements 14, 14*a*. If, for instance, the lever 6 shown on the right of FIG. 3 were turned so as to exceed the initial tension of the torsion spring element 14, the spring element 14 is rotated relative to the shaft 5 in the region of the angle B and is, thereafter, returned when the transverse force decreases. This occurs because the shaft 5 is retained at the opposite end by the key (not shown) between the torsion spring element 14*a* and the shaft 5 and because the other lever (not shown) maintains the position which it occupied before the appearance of the transverse force which overcomes the initial tension of the torsion spring element 14. Should a pivot motion of the lever 6 occur in the opposite sense, i.e. counter clockwise as shown in FIG. 4, the shaft 5 is taken along positively by the spring element 14 via the key 21 and the spring element 14*a* is rotated via the serrations 16. When the thus introduced transverse force exceeds the initial tension of the spring element 14*a*, the inner end 15 is rotated counter clockwise and is thereafter returned with decreasing transverse force since the spring element 14*a* is retained at the outer end by the left lever 6. In this way, the transverse deflections to be transmitted between the two coupled trucks are limited by the spring elements 14, 14*a* which are biased against the shaft 5 to a predetermined amount. The deflections in excess of this amount are absorbed by a corresponding elastic deformation of the spring elements 14, 14*a***.

Figure 5:
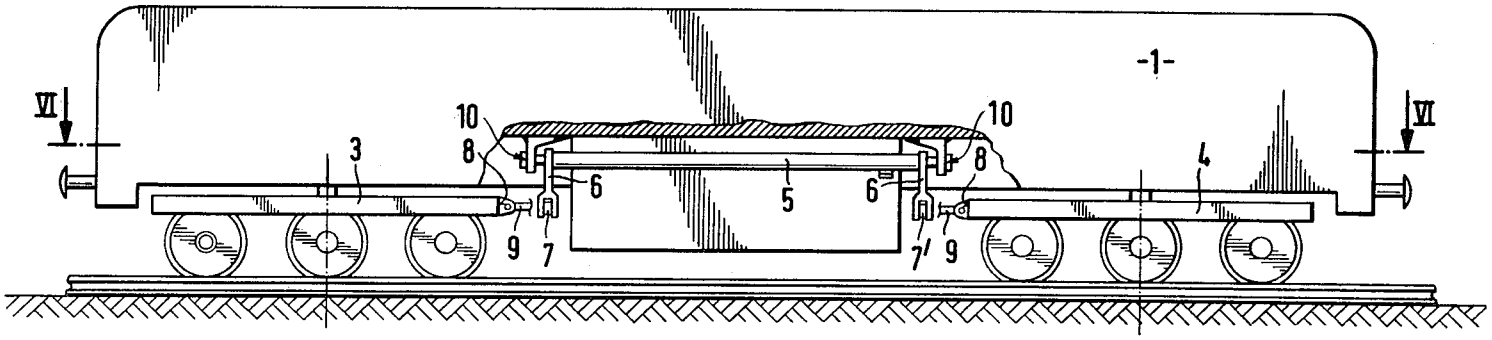
FIG. 5 illustrates a side view of a rail vehicle having a modified coupling assembly in accordance with the invention.
Figure 6:
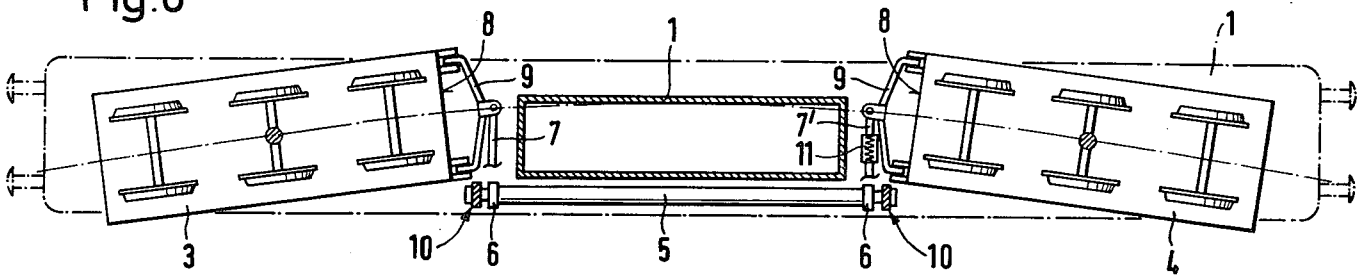
FIG. 6 illustrates a top view of the rail vehicle of FIG. 5 in a track curve.

Referring to FIGS. 5 and 6, wherein like reference characters indicate like parts as above, the coupling assembly may also be utilized with a rail vehicle 1 having two trucks 3, 4 without a middle truck. In this regard, the bearing means 10 for supporting the shaft 5 are secured to the vehicle body 1.

Figure 7:
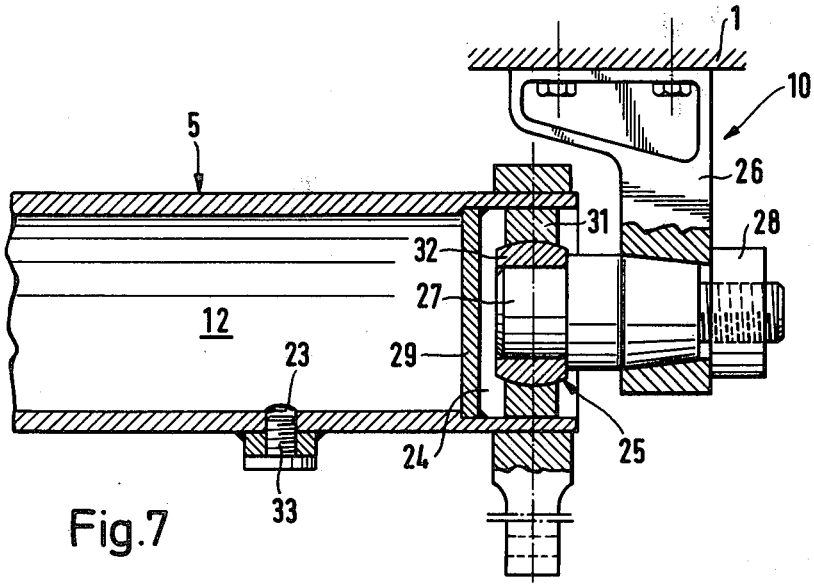
FIG. 7 illustrates a longitudinal cross-sectional view of a part of the coupling assembly of FIGS. 5 and 6.

Alternatively, instead of utilizing torsion spring elements, the shaft 5 may be provided with a pair of spaced apart partitions 29 (only one of which is shown in FIG. 7). These partitions 29 serve to define a storage space 12 for receiving, for example, a fluid operating medium. In order to utilize this medium, the shaft 5 is provided with a threaded aperture 23 which can be closed off by a nipple 33 and to which an inlet and outlet line (not shown) for an operating medium can be connected. Thus, the shaft 5 can be used, for example, as a supply container for diesel oil or for compressed air which may be used in a pneumatic control system of the vehicle. As indicated, the aperture 23 can be positioned for the filling and draining of the storage space 12.

The support means for the shaft 5 may also use a joint-like internal bearing 25 which is disposed within a recessed end region 24 of the shaft 5. This bearing 25 may be constructed as a spherical ball and socket joint and has an outer ring 31 which is connected to the shaft 5 and an inner ring 32 which is fastened to a journal pin 27. The journal pin 27 is, in turn, secured by means of a screw nut 28 to a pillow block 26 bolted to the vehicle body 21. The internal bearing 25 may also be constructed as a self aligning roller bearing.

As shown in FIG. 7, each lever 6 is fastened in the transverse plane of the internal bearing 25 in such a manner that the plane of symmetry of the thickness of the lever 6 coincides with a transverse plane of the bearing 25. The transverse steering rods 7, 7' which establish the connection of the shaft 5 to the triangular frames 9 (FIG. 6) are linked to the free ends of the levers 6. The transverse steering rod 7' shown on the right of FIG. 6 is also provided with a pretensioned restoring spring 11 which is known per se. This spring 11 can be stressed in tension as well as compression and performs the function of the torsion spring element 14 of FIG. 3. This insures the required elastic connection of the truck 3, 4.

What is claimed is:

1. In combination with a rail vehicle having at least two longitudinally spaced trucks for supporting a body; a transverse coupling assembly for coupling said trucks comprising a hollow shaft disposed longitudinally of said trucks and said vehicle, bearing means supporting each end of said shaft relative to said body;

a torsion spring element extending within said shaft at least over one end section, said spring element being secured at one end to said shaft and being relatively rotatable at an opposite end to said shaft within a predetermined angle; and a pair of linkages, each linkage connecting a respective one of said trucks to a respective end of said shaft and including a lever secured to said torsion spring element and connected to a respective one of said trucks.

2. The combination as set forth in claim 1 wherein said means includes a joint-like external bearing secured in a pillow block.

3. The combination as set forth in claim 1 wherein said pillow block is secured to said body.

4. The combination as set forth in claim 1 which further comprises a pair of keys, each said key holding a respective torsion spring element in pretensioned position relative to said shaft.

5. The combination as set forth in claim 1 wherein each rail vehicle has three longitudinally spaced trucks and a body supported on said trucks, and said bearing means supports said shaft on the middle truck of said trucks and each linkage connects a respective one of the end trucks of said trucks to a respective end of said shaft.

6. The combination as set forth in claim 5 wherein each said bearing means includes a pillow block secured to said middle truck and a self-aligning bearing mounted in said pillow block and journalling said shaft end therein.

7. A transverse coupling assembly for a rail vehicle having at least two longitudinally spaced trucks, said assembly comprising a hollow shaft, a means supporting each end of said shaft relative to a vehicle body, a torsion spring element extending within said shaft at least over one end section, said spring element being secured at one end to said shaft and being relatively rotatable at an opposite end to said shaft within a predetermined angle; and a pair of linkages, each linkage being connected to a respective end of said shaft for connecting said shaft end to a truck and including a lever secured to a respective end of said torsion spring element.

8. In combination with a rail vehicle having at least two longitudinally spaced trucks for supporting a body; a transverse coupling assembly for coupling said trucks comprising a hollow shaft disposed longitudinally of said trucks;

a pair of spaced-apart partitions in said shaft defining a storage space therebetween for receiving and storing a fluid operating medium;

means supporting each end of said shaft relative to said body, said means including a joint-like internal bearing within one end of said shaft and having an inner ring secured to a journal pin in a pillow block; and a pair of linkages fixedly connected to said shaft, each linkage connecting a respective one of said trucks to a respective end of said shaft.

9. The combination as set forth in claim 8 which further comprises a pneumatic control system for said vehicle, said system being connected to said storage space to receive a supply of compressed air therefrom.

10. The combination as set forth in claim 8 wherein said storage space contains diesel oil.

11. The combination as set forth in claim 8 wherein said pillow block is secured to said body.

12. The combination as set forth in claim 8 wherein said vehicle has a third truck between said two trucks, and said pillow block is secured to said third truck.

13. A transverse coupling assembly for a rail vehicle having at least two longitudinally spaced trucks, said coupling assembly comprising a hollow shaft disposed longitudinally of said trucks;

means for supporting each end of said shaft relative to a vehicle body, said means including a joint like bearing disposed within each end region of said shaft and a journal pin extending from said bearing;

a pair of linkages fixedly connected to said shafts, each linkage connecting a respective one of said trucks to a respective end of said shaft; and a pair of spaced-apart partitions in said shaft defining a storage space therebetween for receiving and storing a fluid operating medium.

* * * * *